US011786828B2

(12) United States Patent
Shen et al.

(10) Patent No.: US 11,786,828 B2
(45) Date of Patent: Oct. 17, 2023

(54) SWING CONTROL METHOD AND APPARATUS

(71) Applicant: Suzhou Lucky Intelligent Technology Co., Ltd., Jiangsu (CN)

(72) Inventors: Zhiwei Shen, Jiangsu (CN); Xueping Lou, Jiangsu (CN); Xueming Zou, Jiangsu (CN)

(73) Assignee: Suzhou Lucky Intelligent Technology Co., Ltd.

( * ) Notice: Subject to any disclaimer, the term of this patent is extended or adjusted under 35 U.S.C. 154(b) by 0 days.

(21) Appl. No.: 17/504,952

(22) Filed: Oct. 19, 2021

(65) Prior Publication Data

US 2022/0395757 A1 Dec. 15, 2022

(30) Foreign Application Priority Data

Jun. 15, 2021 (CN) ..... 202110662371.6

(51) Int. Cl.
*A63G 9/16* (2006.01)
*A47D 13/10* (2006.01)

(52) U.S. Cl.
CPC ..... *A63G 9/16* (2013.01); *A47D 13/105* (2013.01)

(58) Field of Classification Search
CPC . A63G 9/16; A47D 9/057; A47D 9/02; A47D 13/105
USPC ..... 472/119
See application file for complete search history.

(56) References Cited

U.S. PATENT DOCUMENTS

| | | | | |
|---|---|---|---|---|
| 6,339,304 | B1 * | 1/2002 | Allison | A47D 13/105 318/443 |
| 7,905,791 | B2 * | 3/2011 | Guang | A47D 13/105 340/671 |
| 2011/0256943 | A1 * | 10/2011 | Yeh | A47D 13/105 472/119 |
| 2012/0071253 | A1 * | 3/2012 | Qiu | A47C 3/0255 472/119 |

* cited by examiner

*Primary Examiner* — Kien T Nguyen

(57) ABSTRACT

A swing control method is disclosed. Dual photoelectric sensors and gratings are involved. The method includes: detecting the time when blocked or opening parts of gratings pass through photoelectric sensors; comparing a minimum time value with a time value corresponding to a preset swing amplitude in each swing cycle, and when the minimum time value is not equal to the preset time value, generating a control signal for adjusting an output power of a motor so that the swing amplitude reaches the preset swing amplitude; detecting a current swing direction; and determining whether the current swing direction changes, and if yes, generating a control signal for adjusting the output power of the motor for co-direction supplementary augmentation. The method controls the swing speed of a swing by calculating a value of the time when the blocked or opening parts of the gratings pass through the photoelectric sensors.

10 Claims, 7 Drawing Sheets

SWING CONTROL METHOD AND APPARATUS

FIELD

The present invention relates to the technical field of swing control of swing chairs, and in particular, to a swing control method for a swing dining chair, a swing chair or a swing bed, and to a swing control apparatus.

BACKGROUND

In recent years, swing dining chairs, swing chairs, and swing beds for children have developed rapidly.

However, the high-performance swing control technology patents in the United States and Europe have been controlled by the American company KIDS II, which has controlled the American baby swing market for a long time with its core U.S. Pat. No. 7,905,791 B2 due to high control accuracy and low production costs. On the basis of the structure shown in the invalid U.S. Pat. No. 6,339,304 B1 of Graco, an improvement can be made to a control algorithm to eliminate the defect of low accuracy of the original algorithm, thereby achieving a swing performance comparable to that in the patent of KIDS II to enter the American market.

SUMMARY

An objective of the present invention is to overcome the shortcomings of the prior art, provide a swing control method, and solve the technical problem in the prior art of insufficient accuracy of swing control algorithms for children swings.

In order to solve the technical problem above, the present invention provides the following technical solutions.

In a first aspect, the present invention also provides a swing control method, including the following steps:

- detecting the time when blocked or opening parts of gratings pass through photoelectric sensors;
- comparing a minimum time value with a time value corresponding to a preset swing amplitude in each swing cycle, and when the minimum time value is not equal to the preset time value,
- generating a control signal for adjusting an output power of a motor so that the swing amplitude reaches the preset swing amplitude;
- detecting a current swing direction; and
- determining whether the current swing direction changes, and if yes, generating a control signal for adjusting the output power of the motor for co-direction supplementary augmentation.

Optionally, the detecting the time when blocked or opening parts of gratings pass through photoelectric sensors includes: calculating, by a timer, the pulse time generated on the photoelectric sensors by the blocked or opening parts of the gratings when the gratings move.

Optionally, the detecting a current swing direction includes:

- collecting signals of the dual photoelectric sensors A and B disposed at two ends of a grating disc; and
- detecting a time difference between level signals of phase A and phase B to determine the direction of swing movement.

Optionally, the when the minimum time value is not equal to the preset time value, generating a control signal for adjusting an output power of a motor so that the swing amplitude reaches the preset swing amplitude so that the swing amplitude reaches includes:

- when the minimum time value is less than the preset time value, generating a PWM signal for reducing the output power of the motor; and
- when the minimum time value is greater than the preset time value, generating a PWM signal for increasing the output power of the motor.

In a second aspect, the present invention also provides a swing dining chair. The swing of the swing dining chair is controlled using the swing control method.

In a third aspect, the present invention also provides a swing chair. The swing of the swing chair is controlled using the swing control method.

In a fourth aspect, the present invention also provides a swing bed. The swing of the swing bed is controlled using the swing control method.

In a fifth aspect, the present invention provides a swing control apparatus, including a controller, a motor, swing time detectors, and swing direction detectors.

The swing time detectors are configured to detect the time when blocked or opening parts of gratings pass through photoelectric sensors.

The swing direction detectors are configured to detect a current swing direction.

The controller is configured to compare a minimum time value with a time value corresponding to a preset swing amplitude in each swing cycle, when the minimum time value is not equal to a preset time value, generate a control signal for adjusting an output power of a motor so that the swing amplitude reaches a preset swing amplitude, and determine whether a current swing direction changes, and if the current swing direction changes, generate a control signal for adjusting the output power of the motor for co-direction supplementary augmentation.

Optionally, the swing time detectors include photoelectric sensor and a timer, and the pulse time generated on the photoelectric sensors by the blocked or opening parts of the gratings when the gratings move is calculated by the timer.

Optionally, the swing direction detectors are dual photoelectric sensors; the dual photoelectric sensors are respectively disposed on two sides of a grating disc and respectively denoted as a photoelectric sensor A and a photoelectric sensor B, and the forward or reverse direction of swing is determined through a phase relationship of signals of the dual photoelectric sensors A and B.

Compared with the prior art, the present invention achieves the following beneficial effect: in the present invention, the movement speed of a spindle is calculated according to the pulse time generated on the dual photoelectric sensors when the spindle gratings move, and a drive power of a motor is adjusted by comparing with a preset value and changing a PWM value, and the linearity of the swing is controlled to be smoother, thereby effectively solving the problem of insufficient accuracy. In addition, performing forward and reverse co-direction supplementary augmentation according to the swing direction can correct the swing power in advance so that the swing reaches a preset requirement.

REFERENCE NUMERALS

1. support frame; 2. swing control apparatus; 3. hanging bracket; 4. seat; 5. disc member; 6. grating disc; 7. photoelectric sensor; 8. controller; 9. motor; 10. timer

DETAILED DESCRIPTION

The present invention is further described below in conjunction with the accompanying drawings. The following embodiments are only for illustrating the technical solutions of the present invention more clearly, and cannot be construed to limit the scope of protection of the present invention.

In the prior art, the swing speed of a swing is generally controlled by calculating the number of gratings (or the number of teeth). Because a grating disc is not disposed on a motor shaft, but on an output shaft, and the rotation speed of the output shaft is very small, only one tooth or two teeth pass. The accuracy of such control is very poor, and it cannot meet the requirements of accurate control of the swing speed.

Figure 1:
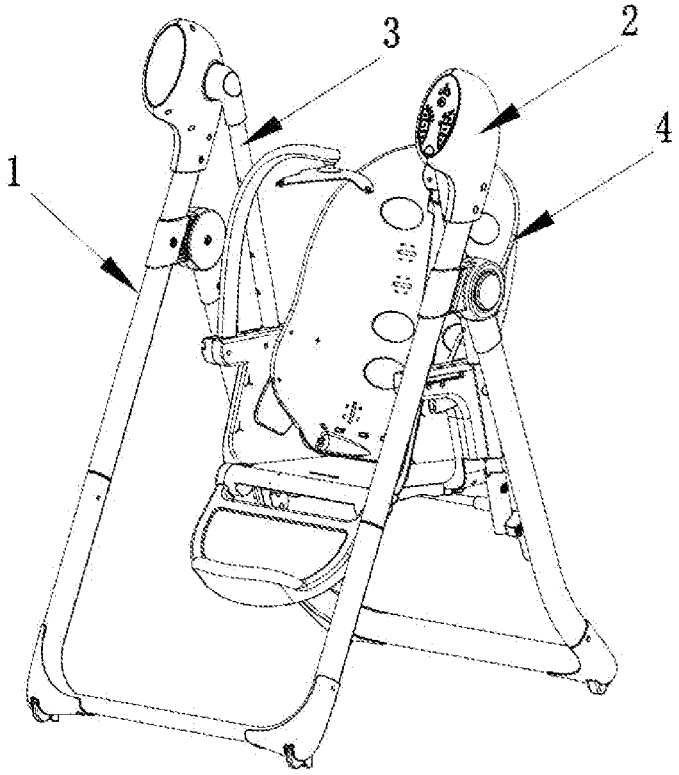
FIG. 1 is a structural diagram of a children's swing dining chair.
Figure 2:
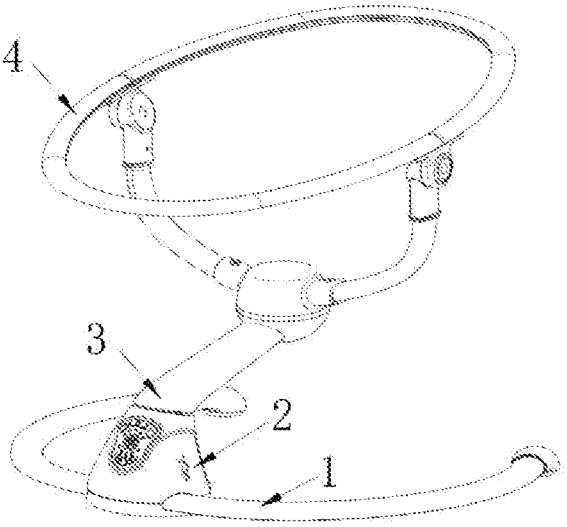
FIG. 2 is a structural diagram of a children's swing chair.
Figure 3:
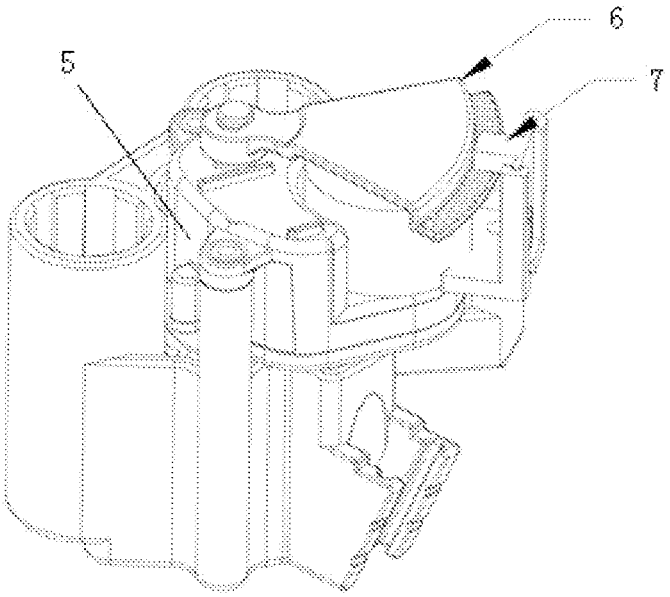
FIG. 3 is an installation structure diagram of gratings and photoelectric sensors.
Figure 6:
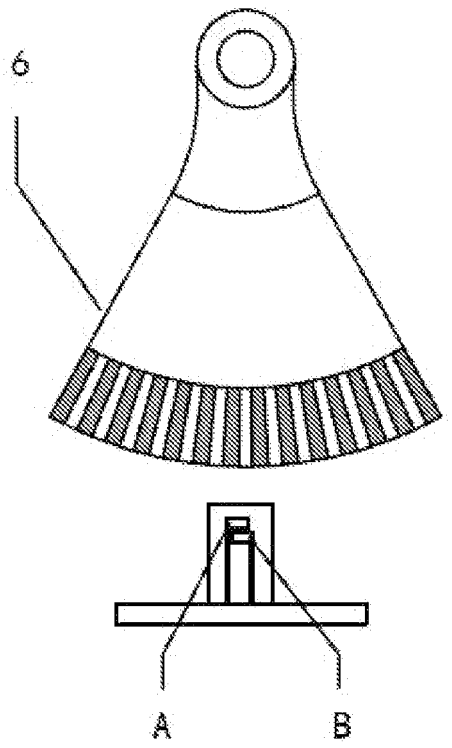
FIG. 6 is a structural diagram of the grating disc and photoelectric sensor of the present invention.

The structure of a children's swing dining chair is shown in FIG. 1. The top of a support frame 1 is connected to a pair of hanging brackets 3, the pair of hanging brackets 3 are respectively connected to a seat 4, a swing control apparatus 2 is also mounted at the top of the support frame 1, and the swing control apparatus 2 drives the hanging brackets 3 to drive the seat 4 to swing. The structure of a children's swing chair is shown in FIG. 2. A hanging bracket 3 is connected to a support frame 1, the hanging bracket 3 is connected to a seat 4, a swing control apparatus 2 is also mounted at the top of the support frame 1, and the swing control apparatus 2 drives the seat 4 to swing. The swing control apparatus 2 includes a controller 8 and a motor 9. A spindle of the motor 9 has a disc member 5 and a radial extension part. A grating disc 6 extends from the radial extension part, as shown in FIG. 3 and FIG. 6. In the embodiment shown here, 12 gratings extend on the grating disc 6, an interval between adjacent gratings is about 2°, and the width of the grating is about 4°. In a swing cycle, it is necessary to control the swing frequency to be equal to the intrinsic frequency of the swing, and control the swing amplitude to reach a preset maximum amplitude, so that the swing has higher stability and accuracy.

Figure 4:
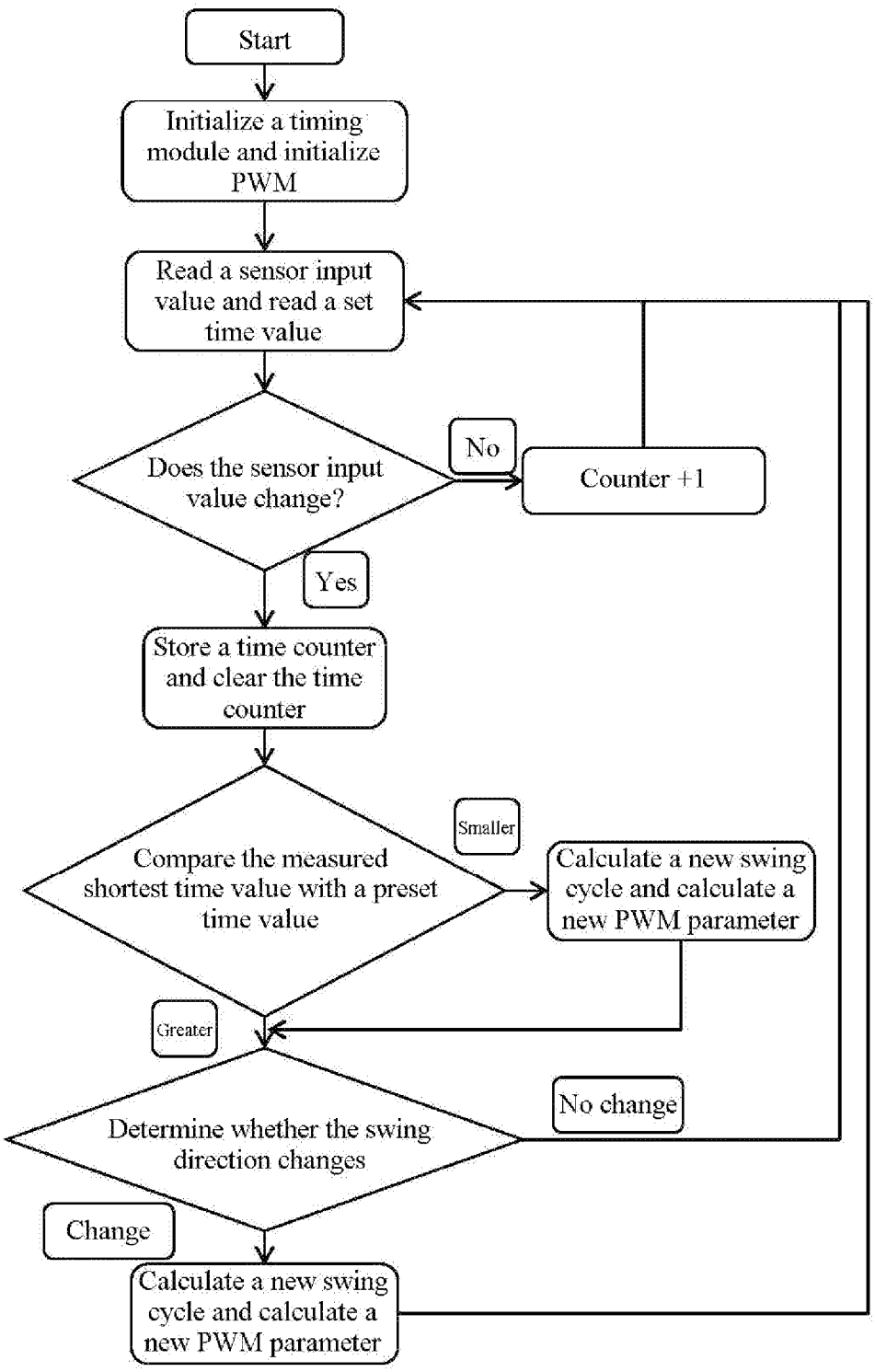
FIG. 4 is a flowchart of a method of the present invention.

A swing control method of the present invention, as shown in FIG. 4, includes the following steps.

At step 1, a timing module is initialized, and the PWM is initialized; and a timer 10 in the timing module is used for timing, and PWM waves are used for adjusting a motor drive power.

At step 2, input values of photoelectric sensors are read, a set time value is read, and the set value is calculated according to a swing amplitude requirement on a swing in actual use.

Photoelectric sensors in the prior art are used for collecting the speed and movement direction of the swing. A light source is provided on one side of the grating disc 6, and two photoelectric sensors 7 are placed at opposite ends of the grating disc 6, and are respectively denoted as a photoelectric sensor A and a photoelectric sensor B.

When the motor 9 drives the swing movement, the grating disc 6 is driven to swing between the light source and the photoelectric sensors 7. The photoelectric sensors output feature signals that characterize whether the gratings are blocked. For example, when the gratings are not blocked (corresponding to ON), high-level pulses are generated on the photoelectric sensors, and the time intervals corresponding to the OFF, ON, and OFF of the grating disc output by the photoelectric sensors are recorded.

In the present invention, the movement speed of a motor spindle, i.e., the speed of the swing, is calculated by the pulse time generated on (any) photoelectric sensor when the spindle grating moves.

Signals of the photoelectric sensor A and the photoelectric sensor B disposed at two ends of the grating disc are collected. The movement direction of the swing is determined according to the phase signals of the dual photoelectric sensors A and B. If a sensor A first detects resistance grids of the grating disc, the phase relationship is AB-AB-AB, and it can be determined that the swing swings from A to B, a forward direction. If the sensor B first detects resistance grids of the grating disc, the phase relationship is BA-BA-BA, and it can be determined that the swing direction is from B to A, a reverse direction.

At step 3, whether input values of the photoelectric sensors change is determined, and if not, step 4 is proceeded, and if yes, step 5 is proceeded.

A change in the input value of the photoelectric sensor indicates that the motor drive power is greater than a friction force, and no change indicates that the motor drive power is less than the friction force.

At step 4, if the time counter is increased by 1, execution is restarted from step 2.

At step 5, the time counter is stored, and then the time counter is cleared.

At step 6, the minimum time value is selected to compare with a preset time value (corresponding a preset swing amplitude);

if the minimum time value is less than the preset time value, step 7 is performed to adjust the PWM drive to reduce the motor power;

if the minimum time value is greater than or equal to the preset time value, step 8 is performed to adjust the PWM drive to increase the motor power; and if the shortest time is equal to the preset time value, the PWM value is not increased.

In the present invention, the minimum time value is selected as the basis for determining an instantaneous swing speed, that is, it is considered that when the lowest point is reached, the time interval for passing gratings is the shortest and the swing speed is the fastest. The motor drive power is adjusted timely so that the swing chair can reach a set swing amplitude.

At step 7, a new swing cycle is calculated, and a new PWM parameter is calculated; and step 8 is proceeded.

The swing cycle is calculated by an A/B reversing time difference detected by the dual photoelectric sensors.

A PWM control signal for adjusting the output power of the motor 9 is generated so that the swing amplitude reaches the preset swing amplitude.

When the minimum time value is less than the preset time value, a PWM signal for reducing the output power of the motor 9 is generated.

When the minimum time value is greater than the preset time value, a PWM signal for increasing the output power of the motor 9 is generated.

At step 8, whether the swing direction changes is determined, if not, execution is restarted from step 2, and if yes, step 9 is proceeded.

An MCU determines the forward or reverse direction of the swing by reading a signal phase difference between the dual photoelectric sensors A and B. When the swing chair reaches the highest point, the movement direction changes, and forward and reverse co-direction supplementary augmentation is performed according to the swing direction.

At step 9, a new swing cycle is calculated, and a new PWM parameter is calculated. A PWM control signal for adjusting the output power of the motor 9 is generated for co-direction supplementary augmentation.

Because the swing cycle may change at any time when the swing is subject to external force or wind resistance, etc. in operation, the cycle needs to be recalculated for each swing cycle. The swing frequency is controlled to be equal to the eigen frequency of the swing. A PWM control signal for adjusting the output power of the motor 9 is generated for co-direction supplementary augmentation.

In the present invention, the swing speed (i.e., the amplitude) of the swing is controlled by calculating a value of the time for passing by a grating, thereby improving the control accuracy, and effectively solving the problem of insufficient accuracy. In addition, performing forward and reverse co-direction supplementary augmentation according to the swing direction can correct the swing power in advance so that the swing reaches a preset requirement.

The swing control method is applicable to the children's swing dining chairs, swing beds, swing chairs, etc. in the prior art.

Figure 5:
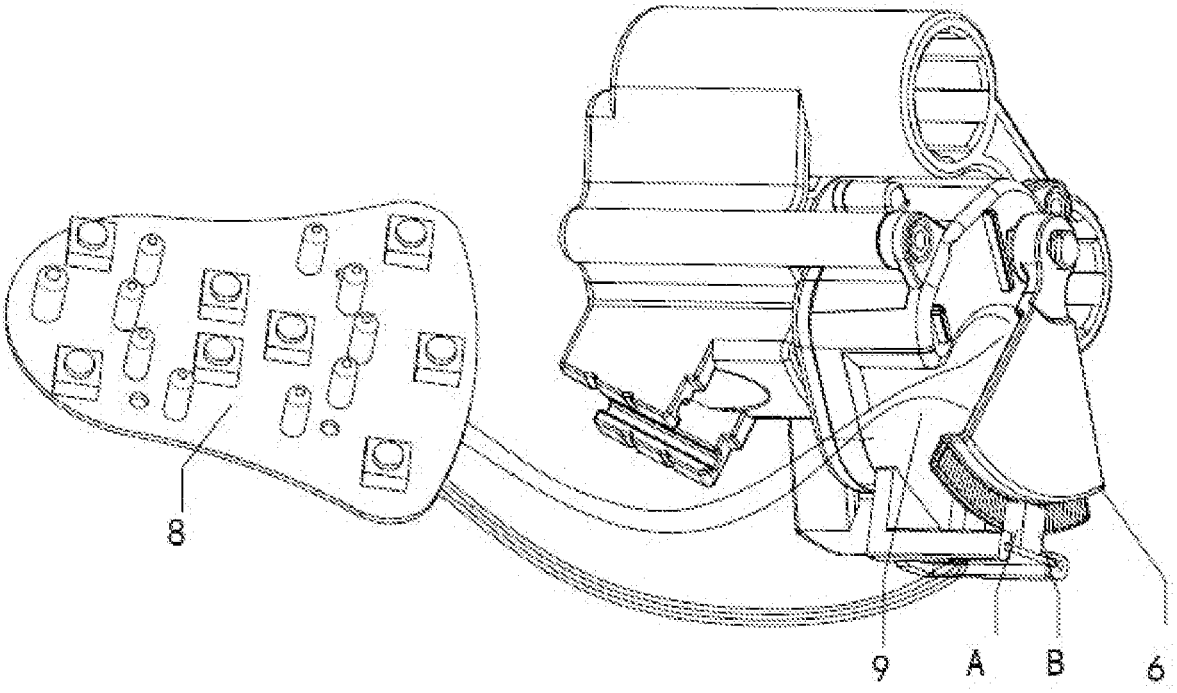
FIG. 5 is a structural diagram of the swing control apparatus of the present invention.

FIG. 5 is a structural diagram of the swing control apparatus of the present invention. A swing control apparatus according to embodiments of the present invention includes a controller 8, a motor 9, swing time detectors, and swing direction detectors.

Figure 7:
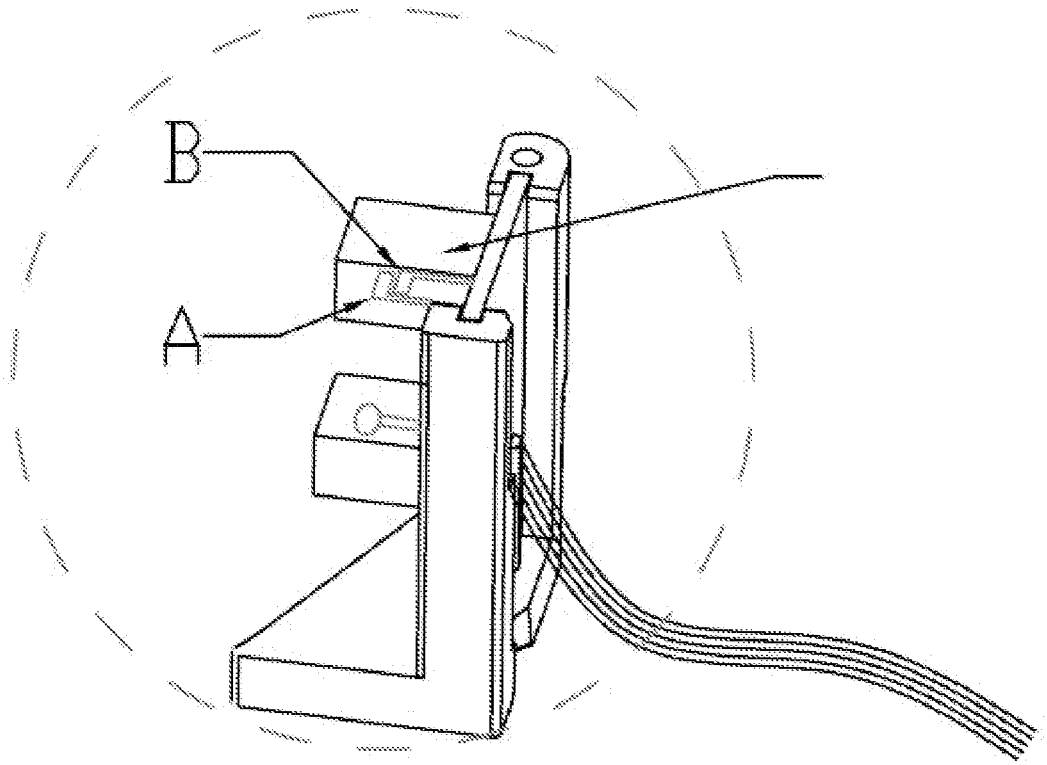
FIG. 7 is a structural diagram of the photoelectric sensor A and photoelectric sensor B of the present invention.
Figure 8:
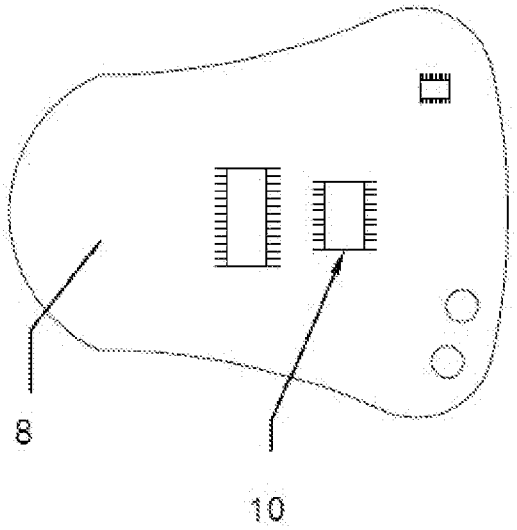
FIG. 8 is a connection schematic diagram of the controller and timer of the present invention.

The swing time detectors are configured to monitor the pulse time generated on the dual photoelectric sensors when a single grating moves. The swing time detectors includes the dual photoelectric sensors and timer 10, the dual photoelectric sensors includes the photoelectric sensor A and the photoelectric sensor B (reference to FIG. 7), the photoelectric sensor A and the photoelectric sensor B are placed at opposite ends of the grating disc 6, the timer 10 is set on controller 8 (reference to FIG. 8), the pulse time generated by grating occlusion or opening part on photoelectric sensor 7 is calculated by timer 10 when grating moves.

The swing direction detectors are configured to monitor a current swing direction. The swing direction detectors includes the dual photoelectric sensors, the dual photoelectric sensors includes the photoelectric sensor A and the photoelectric sensor B (reference to FIG. 7), The positive and negative steering of shaking is determined by the phase relation between photoelectric sensor A and photoelectric sensor B.

The controller 8 is configured to compare a minimum swing time value with a time value corresponding to a preset swing amplitude in each swing cycle, and when the two values are not equal, generate a control signal for adjusting an output power of a motor 9, determine whether a current swing direction changes, and when the current swing direction changes, generate a control signal for adjusting the output power of the motor 9.

A timer 10 calculates the time from a rising edge to a falling edge of the pulse as the time for the swing passing a grating, and then the speed of the swing is calculated through the time value. In the present invention, the minimum time value is selected to calculate the movement speed of the swing at the highest point, and the motor drive power is adjusted timely to reach a set swing amplitude.

Upon swing to the highest point, the swing is reversed under the action of gravity. The controller 8 determines the forward or reverse direction of the swing by reading the phases of dual photoelectric sensor tubes A and B and performs forward and reverse co-direction supplementary augmentation according to the determined direction.

In the present invention, the swing speed of the swing is controlled by calculating a value of the time for passing a grating, and the time value can be calculated to 0.001 second, thereby improving the control accuracy and effectively solving the problem of insufficient accuracy.

Nowadays, common swing devices include swings and swing chairs. The swing drive control apparatus can be directly used in the swings and swing chairs.

A person skilled in the art should understand that the embodiments of the present application can be provided as a method, a system, or a computer program product. Therefore, the present application may be embodied in the form of complete hardware embodiments, complete software embodiments, or embodiments combining software and hardware. Moreover, the present application may use the form of a computer program product implemented on one or more computer available storage media (including but not limited to a disk memory, a CD-ROM, an optical memory, etc. including computer available program codes.

The present application is described with reference to flowcharts and/or block diagrams of the method, the device (system), and the computer program product according to the embodiments of the present application. It is understood that, each step and/or block in a flowchart and/or a block diagram and the combination of steps and/or blocks in the flowchart and/or block diagram can be implemented by computer program instructions. These computer program instructions can be provided to a processor of a general-purpose computer, a special-purpose computer, an embedded processor, or other programmable data processing devices to produce a machine, so that an apparatus for implementing functions specified in one or more steps in the flowchart and/or one or more blocks in the block diagram can be generated through the instructions executed by the processor of the computer or other programmable data processing devices.

These computer program instructions can also be stored in a computer readable memory that can guide the computer or other programmable data processing devices to operate in a particular manner, so that the instructions stored in the computer readable memory generate a product including an instruction apparatus, and the instruction apparatus implements the functions specified in one or more steps in the flowchart and/or one or more blocks in the block diagram.

These computer program instructions can also be loaded on the computer or other programmable data processing device to enable the computer or other programmable devices to execute a series of operation steps to perform computer-implemented processing, so that the instructions executed on the computer or other programmable devices provide steps for implementing the functions specified in one or more steps in the flowchart and/or one or more blocks in the block diagram.

The above are only the preferred embodiments of the present invention. It is noted that, for those of ordinary skill in the art, several improvements and modifications can be made without departing from the technical principle of the present invention, and these improvements and modifications may also be regarded as falling within the scope of protection of the present invention.

What is claimed is:

1. A swing control method, comprising the following steps:

detecting a time when blocked or opening parts of gratings pass through photoelectric sensors;

comparing a minimum time value with a time value corresponding to a preset swing amplitude in each swing cycle, and when the minimum time value is not equal to the time value corresponding to the preset swing amplitude, generating a control signal for adjusting, an output power of a motor so that a swing amplitude reaches the preset swing amplitude;

detecting a current swing direction; and determining whether a current swing direction changes, and if yes, generating a control signal for adjusting the output power of the motor for co-direction supplementary augmentation.

2. The swing control method according to claim 1, wherein in step of detecting a value of the time when the blocked or opening parts of the gratings pass through the photoelectric sensors, calculating, by a timer, a pulse time generated on the photoelectric sensors by the blocked or opening parts of the gratings when the gratings move.

3. The swing control method according to claim 1, wherein in step of detecting a current swing direction, collecting phase signals of dual photoelectric sensors A and B disposed at end portions of a grating disc; and detecting a time difference between level signals of phase A and phase B to determine the direction of swing movement.

4. The swing control method according to claim 1, wherein in step of when the minimum time value is not equal to the preset time value, generating a control signal for adjusting an output power of a motor so that the swing amplitude reaches the preset swing amplitude so that the swing amplitude reaches, when the minimum time value is less than the preset time value, generating a PWM signal for reducing the output power of the motor; and when the minimum time value is greater than the preset time value, generating a PWM signal for increasing the output power of the motor.

5. A swing dining chair, wherein a swing of the swing dining, chair is controlled by using the swing control method according to claim 1.

6. A swing chair, wherein a swing of the swing chair is controlled by using the swing control method according to claim 1.

7. A swing bed, wherein a swing of the swing bed is controlled by by using swing control method according to claim 1.

8. A swing control apparatus for controlling a swing device, comprising swing time detectors for detecting a time when blocked or opening parts of gratings pass through photoelectric sensors;

swing direction detectors for detecting a current swing direction of the swing device; and a controller for comparing a minimum time value with a time value corresponding to a preset swing amplitude in each swing cycle, when the minimum time value is not equal to the time value corresponding to the preset swing amplitude, generating a control signal for adjusting an output power of a motor for driving the swing device so that a swing amplitude reaches the preset swing amplitude, and determining whether the current swing direction changes, and if yes, generating a control signal for adjusting the output power of the motor for co-direction supplementary augmentation.

9. The swing control apparatus according to claim 8, wherein the swing time detectors comprise a timer, and a pulse time generated on the photoelectric sensors by the blocked or opening parts of the gratings when the gratings move is calculated by the timer.

10. The swing control apparatus according to claim 8, wherein the swing direction detectors are dual photoelectric sensors, the dual photoelectric sensors are respectively disposed on two sides of a grating disc and respectively denoted as a photoelectric sensor A and a photoelectric sensor B, and a forward or reverse direction of a swing of the swing device is determined through a phase relationship of signals of the dual photoelectric sensors A and B.

* * * * *